US005666329A

United States Patent [19]

Buro et al.

[11] Patent Number: 5,666,329

[45] Date of Patent: Sep. 9, 1997

[54] ELECTRONIC CONTROL DEVICE

[75] Inventors: Davide Buro; Frank-Thomas Eitrich, both of Reutlingen; Michael Strugala, Remseck, all of Germany

[73] Assignee: Robert Bosch GmbH, Stuttgart, Germany

[21] Appl. No.: 436,382

[22] PCT Filed: Aug. 25, 1994

[86] PCT No.: PCT/DE94/00981

§ 371 Date: May 11, 1995

§ 102(e) Date: May 11, 1995

[87] PCT Pub. No.: WO95/07501

PCT Pub. Date: Mar. 16, 1995

[30] Foreign Application Priority Data

Nov. 9, 1993 [DE] Germany ..... 43 30 906.2

[51] Int. Cl.[6] ..... G04F 8/00; F02B 3/00

[52] U.S. Cl. ..... 368/5; 368/113; 123/478; 123/492

[58] Field of Search ..... 368/1, 5, 6, 9, 368/10, 107–113; 123/416–418, 1, 422, 491, 492; 364/569

[56] References Cited

U.S. PATENT DOCUMENTS

| | | | |
|---|---|---|---|
| 3,809,029 | 5/1974 | Wakamatsu et al. | 123/32 EA |
| 4,245,605 | 1/1981 | Rice et al. | 123/492 |
| 4,267,810 | 5/1981 | Wesemeyer et al. | 123/416 |
| 4,285,314 | 8/1981 | Kiencke et al. | 123/422 |
| 4,354,239 | 10/1982 | Kanegae | 364/431.05 |
| 4,363,307 | 12/1982 | Amano et al. | 123/493 |
| 4,942,559 | 7/1990 | Fleck et al. | 368/113 |
| 4,952,367 | 8/1990 | Porter et al. | 364/200 |

FOREIGN PATENT DOCUMENTS

| | | |
|---|---|---|
| 158867 | 10/1985 | European Pat. Off. . |
| 3100825 | 8/1982 | Germany . |
| 04023021 | 5/1992 | Japan . |

*Primary Examiner*—Vit W. Miska
*Attorney, Agent, or Firm*—Michael J. Striker

[57] ABSTRACT

An electronic control device for controlling a fuel injection starting time and an injection duration in an internal combustion engine has an event device (E) which generates an event signal (ES) as a function of a prescribed occurrence of an event and a device for controlling or setting the injection duration including a first register (R1), a loading device (L) and a counter (Z). The event device (E) includes a second register (R2), a clock device (TE) and a comparator (K) which compares a stored register value in the second register (R2) with clock data from the clock device (TE) to produce a comparator signal for generation of the event signal (ES) when the stored register value corresponds to the clock data from the clock device. A variable register value for the injection duration is stored in the first register (R1) as a starting value of the counter when the event signal (ES) is input into the loading device (L) and the counter and the injection process are started when the variable register value is input into the counter (Z) and stopped when the counter reaches a predetermined count.

33 Claims, 11 Drawing Sheets

ELECTRONIC CONTROL DEVICE

BACKGROUND OF THE INVENTION

The invention relates to an electronic control device for controlling a fuel injection starting time and a fuel injection duration in an internal combustion engine. Such electronic control devices can be used to perform a variety of functions. One activity, in particular a control function, is carried out according to the counter state of a counter. This activity can take place for example when the counter is counting or when it has reached a specific counter state. The counter is connected to a clock source which controls the counting in the counter. The range of application of known electronic control devices is limited by the relatively rigidly prescribed possibilities.

SUMMARY OF THE INVENTION

The control device according to the invention has, in contrast, the advantage that both the starting time of the counter and the counting interval can be reset variably and always to a respective desired value during operation as a function of desired parameters so that the control functions can be instantaneously influenced during ongoing operation. This means that a device which is actuated by the control device according to the invention can be operated in an optimum way as a function of the aforesaid parameters. In particular, the electronic control device is suitable for operating an internal combustion engine, preferably in order to realize an injection control and/or an ignition control. In the case of injection control, the start of injection and the duration of injection are to be realized as a function of the crankshaft angle and further parameters. Since, according to the invention, a first register is assigned to the counter, into which register a first, prescribable, in particular variable, register value can be input. It is possible to feed this register value as an instantaneous counter state to the counter by means of a loading device in order to set it. An event device is assigned to the loading device and triggers, by means of an event signal, the setting of the counter by starting the loading device as a function of a given occurrence of an event. The aforesaid functions can be realized in an optimum way. If the counting interval of the counter corresponds to the duration of injection, the duration of injection can be set correspondingly as a function of the register value which is written into the first register. The injection process occurs when the counter starts and ends when it has reached a specific counter state. However, the counter is not started until the event device triggers the setting of the counter, as a function of the prescribable occurrence of an event, by starting the loading device. When the event occurs, the first register value of the first register is fed to the counter by means of the loading device. This counter then starts with a counter state corresponding to the register value. By means of the prescribable occurrence of the event, the injection time can thus be determined with the aforesaid injection control of an internal combustion engine. Since it is possible to influence the occurrence of the event, and it is also possible to vary the register value and thus the counting period of the counter, in the aforesaid example of the motor vehicle injection control it is possible to match the injection time and duration of injection to the continuously changing operating conditions while a vehicle is being driven.

According to one embodiment of the invention there is provision for the counter-state evaluation unit to carry out the respectively appropriate activity when the counter starts, during counting and/or when a prescribable final counter state has been reached. It is therefore possible to trigger a control function only when the counter starts, to carry out a control function during the counting process and/or to carry out the control function when a prescribable final counter state has been reached. At the same time, it is possible for the counter to increment or, according to a different exemplary embodiment, for the counter to decrement. If decrementing is selected, the prescribable final counter state can be defined in particular by the value zero, i.e. when the counter has counted backwards from an initial value to the value zero, the counter remains stationary. Then, it no longer counts any further.

It is advantageous if the event device has at least one comparator which compares a second, prescribable, in particular variable, register value of a second register with the value of a clock device, and that the the occurrence of the event is recognized by the identity of the second register value and the value of the clock device. Thus, by correspondingly stipulating the second register value, the occurrence of the event can be controlled. The clock device can, for example, run through periodic clock cycles so that, whenever the second register value is identical with the data of a specific clock cycle, the comparator detects this identity and thus triggers the event signal. Since the second register value is variable, instantaneous states can thus be taken into account.

According to another embodiment of the invention there is provision for the clock source to have a constant time base. Alternatively, it is also possible for the clock source to be designed as an asynchronous source. A "constant time base" means that equidistant intervals are present between the clock pulses. In the case of asynchronous sources, the clock period is of varying lengths.

According to another embodiment of the invention there is provision for the clock source to have a plurality of individual clock sources and for the clock data or signal of the clock source to be provided to the counter by selecting one of the individual clock sources by means of a first selection device. It is thus possible to select from a plurality of clock sources one clock source which determines the counting of the counter. If operating circumstances change, a different individual clock source can be selected, as a result of which a corresponding change of the clock counting takes place.

Furthermore, it is advantageous if the clock source has a plurality of individual clock sources which interact with a first multiplexer, and clock data of one of the individual clock sources is selected at the multiplexed clock output of the first multiplexer by means of a first timing selection device, and fed to the counter. Compared to the previously mentioned exemplary embodiment where the clock source is selected from a plurality of individual clock sources there is the difference that all the individual clock sources interact with the first multiplexer so that the clock signals of all the individual clock sources are made available at the multiplexed clock output of the first multiplexer. By means of the first timing selection device, the clock which is to be fed to the counter is then selected from the plurality of clock signals at the multiplexed clock output.

Preferably, the first timing selection device has a first AND element, one input of the first AND element being connected to the multiplexed clock output of the first multiplexer. A first selection signal for selecting the timing of the clock is fed to a further input of the first AND element. If the first selection signal is present at the input of the AND element, clock data which arrives at the other input of the AND element is transmitted to the output of the first AND element and fed to the counter.

According to another embodiment of the invention there is provision for a first register to have a plurality of individual registers and for one of the individual registers to be capable of being selected by means of a second selection device in order to provide the first register value. In this way, it is possible to feed different starting values to the counter. These different starting values are written into the first individual registers, only that register value which is the value of the selected individual register being fed to the counter when the event takes place.

It is also advantageous if the clock device has a plurality of individual clock data of signal devices and if the clock is provided by selecting one of the individual clock devices at the comparator by means of a fourth selection device. Thus, it is possible to vary the clock data of the clock device. It is possible to select that individual clock device which is most suitable for the aimed-at solution of the function in question.

It is also possible for the clock device to have a plurality of individual clock devices which interact with a second multiplexer and for the clock data or signal of one of the individual clock devices to be selected at the multiplexed clock output of the second multiplexer by means of a second timing selection device and to be fed to the comparator. Thus, all of the clock signals of the individual clock devices are present at the output of the second multiplexer, the clock data or signal which is used being selected from this number of clock signals by means of the timing selection device. For this purpose, the second timing selection device can preferably have a second AND element, one input of the second AND element being connected to the multiplexed clock output of the second multiplexer. A second output signal is fed to a further input of the second AND element for the purpose of selecting the timing of the clock to be used, the output of the second AND element being connected to the comparator so that the selected clock can be fed in.

Alternatively, it is also possible for the clock device to have a plurality of individual clock devices which are each connected to one input of a respective one of a plurality of individual comparators in each case, for the second register value to be fed to a second input of each comparator, and for the event signal to be provided by selecting one of the comparators by means of a fifth selection device. As a function of the coincidence of the data value of the second register and the data of the individual clock devices, a signal which is fed to the fifth selection device is thus emitted at the corresponding comparator. One of these signals is selected by the fifth selection device to form the event signal.

There may be provision for the clock device to have a plurality of individual clock devices which interact with a third multiplexer, for one input of the comparator to be connected, preferably via a multiplex clock-data bus, to the multiplexed clock output of the third multiplexer, for the addresses of the clock data of the individual clock devices to be fed, preferably via a clock-address bus, to an address selection circuit, and for the output of the comparator to be connected, by means of a sixth selection device, for the purpose of outputting the event signal. Because of the third multiplexer, the clock signals of all the individual clock devices are available at its output. These clock signals are fed to one input of the comparator. The second register value is present at the other input of the comparator. If there is identity at the inputs of the comparator, the comparator transmits an output signal to the sixth selection device. From this plurality of comparator output signals, one is selected as event signal using the sixth selection device.

The sixth selection device preferably has a third AND element, one input of the third AND element being connected to the output of the comparator, and one further input of the third AND element being connected to the address selection circuit. If the address selection circuit transmits an output signal to the input of the third AND element when a specific address occurs, and if at the same time an output signal from the comparator is present, the event signal is emitted at the output of the third AND element. The addresses which are fed to the address selection circuit originate from the individual clock devices, that is, an address is assigned to each clock output of each individual clock device.

In order to reduce an electromagnetic emission and in order to reduce power consumption, the data of the individual clock devices are only transmitted onto the common multiplex clock-data bus if the data of one of the individual clock devices have changed or if a corresponding request is made.

Preferably, the data of the clock-address bus are transmitted by the multiplex clock-data bus chronologically before the data of the associated individual clock device. As a result, the decoding of the selection of the clock device is timed differently from that of the corresponding data. This pipelining structure makes a higher clock rate possible.

It is preferred if the address of the clock data, like the clock data themselves, of the individual clock devices are transmitted on the multiplex clock-data bus. The addresses are transmitted chronologically before the clock data and a memory for the addresses is provided. Given the number of individual clock devices this reduces the number of address lines. However, as a result of this the maximum counting speed is reduced. The aforesaid memory is present so that the respective address is available when the clock data arrive.

In addition, there may be provision for the clock source and/or the clock device each to have a device for programmable extraction and insertion of data bits. By extracting and inserting data bits it is, for example, possible to interpret the 720°, necessary for the motor vehicle control, of a crankshaft engine cycle with an identical clock device (angle source) as the 360° crankshaft position as well.

The clock source and/or the clock device can be constructed as a timer. However, it is also possible for the clock source and/or the clock device to be constructed as an angle value transmitter. The clock source and/or the clock device can, however, also be realized in a different way, for example they emit a clock pulse whenever a specific situation occurs.

BRIEF DESCRIPTION OF THE DRAWING

The objects, features and advantages of the invention will now be illustrated in more detail with the aid of the following description of the preferred embodiments, with reference to the accompanying figures in which.

DESCRIPTION OF THE EXEMPLARY EMBODIMENTS

Figure 1:
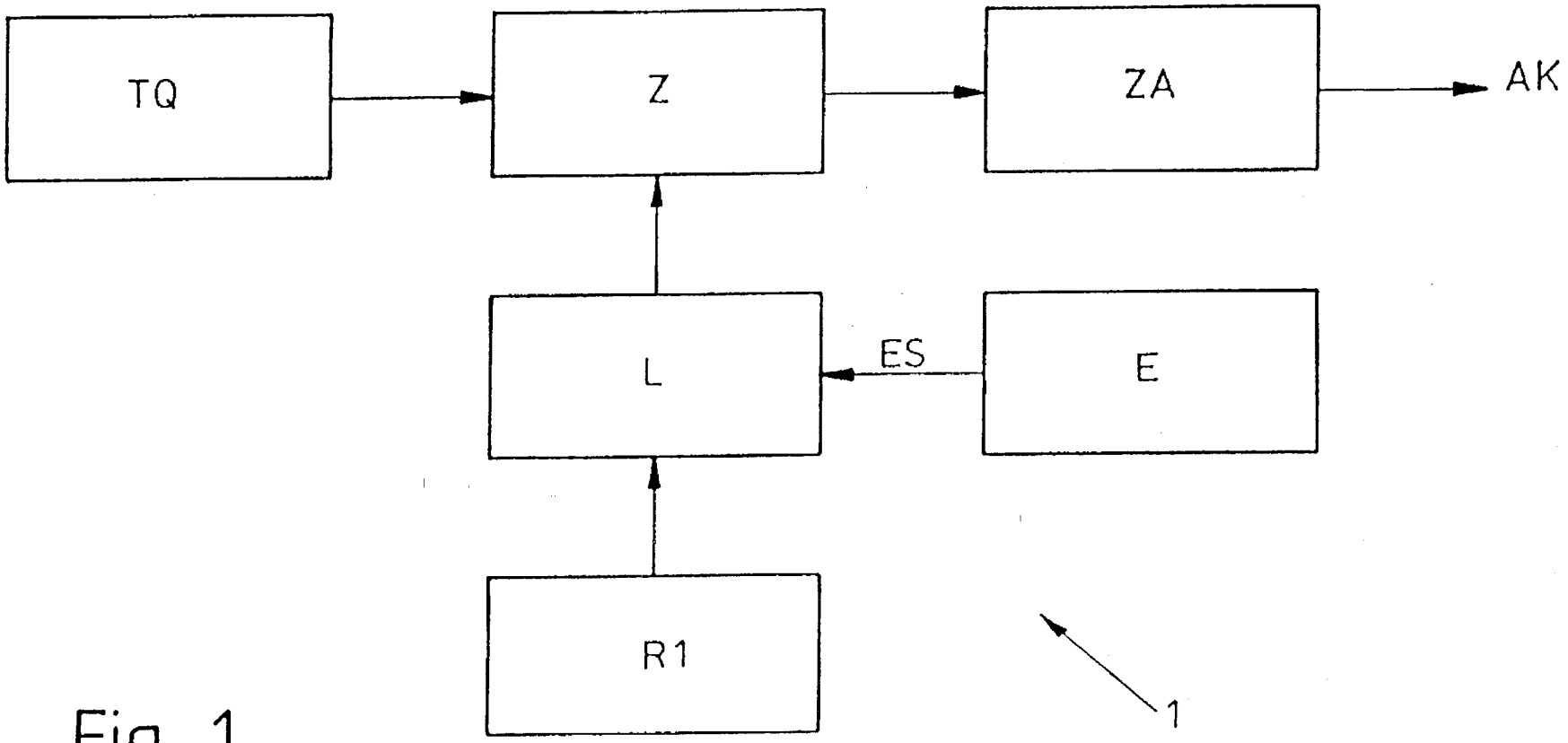
FIG. 1 shows a block circuit diagram of the control device.

FIG. 1 shows a block circuit diagram of an electronic control device 1. A clock source TQ is connected to a counter Z. The clock source TQ determines the clock counting of the counter Z. A counter-state evaluation unit ZA is connected to the output of the counter Z. As soon as the counter Z has a specific state, this is detected by the counter-state evaluation unit ZA and the signal for the triggering of an activity AK is emitted at the output. In addition, a first register R1 into which a first, prescribable, in particular variable register value can be written is illustrated in FIG. 1. The register value is dependent on parameters which originate from the system to be controlled. However, it is alternatively also possible for a fixed, that is to say non-variable, value to be stored in the first register R1.

The register value of the register R1 is fed to a loading device L. This loading device L loads the first register value in the counter Z when an event signal ES is fed from an event device E to the loading device L. This causes the counter Z to be set to the first register value as counter starting value. According to the clock signal of the clock source TQ, the counter counts, starting from this counter state, until a specific final counter state is reached. It is possible for the counter to decrement and for the final counter state to have the value zero. However, another final counter state, which is different from zero, may also be provided. When this final counter state is reached, this is registered by the counter-state evaluation unit ZA and the activity signal AK is output. Alternatively, it is, of course, also possible for the counter to increment, that is to say the initial counter state (value of the first register) is smaller than the final counter state.

As a function of the prescribable occurrence of an event, the event device E transmits the event signal ES to the loading device L which then starts the counter by writing the first register value into the counter as counter starting value. The occurrence of the event is also dependent on the corresponding parameters of the process to be controlled.

The control device 1 in FIG. 1 can be used for example in an injection module in motor vehicle technology. Whenever a specific crankshaft angle of an internal combustion engine is present, the event occurs, that is to say the event device E transmits the event signal ES to the loading device L. As a result, the start of injection is specified relative to the crankshaft angle. If the operating parameters of the internal combustion engine change, the time of the start of injection, that is to say the occurrence of the event, can be correspondingly varied. A value which corresponds to the duration of injection is written into the first register R1 as a function of operating parameters of the internal combustion engine. This value can also be varied while the combustion engine is operating. When the event signal ES is fed to the loading device, the injection begins and lasts until the counter Z has counted to the final counter state starting from the first register value. When the final counter state is reached, the evaluation unit ZA outputs the activity signal AK as a result of which the injection is terminated. The duration of injection can thus be prescribed by means of the first register value.

Figure 2:
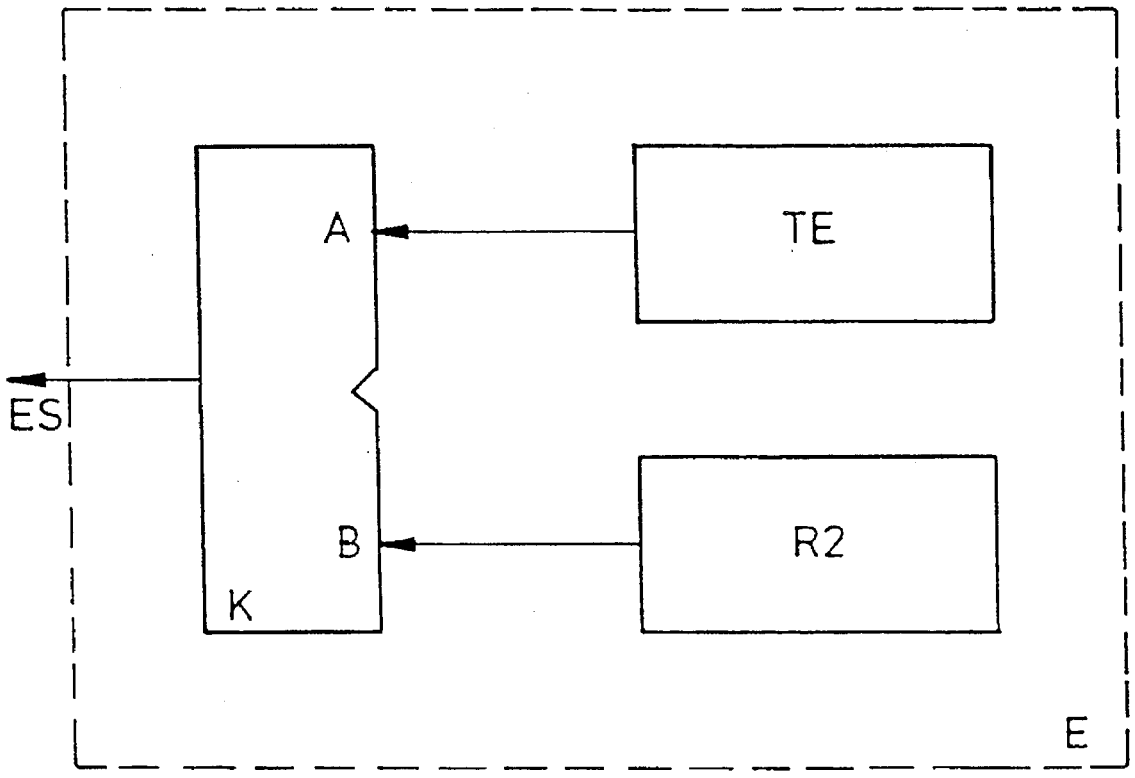
FIG. 2 shows a block circuit diagram for a circuit for the formation of an event signal.

FIG. 2 shows a block circuit diagram of the event device E. It has a clock device TE and a second register R2. A second prescribable, in particular variable, register value is written into the second register R2. This second register value is transmitted to the input B of a comparator K. The output of the clock device TE is connected to a further input A of the comparator K. If an identical value is present at the inputs A and B of the comparator K, the comparator K emits the event signal ES at its output. The clock device TE can be for example an angle value transmitter whose angle value corresponds to the respective crankshaft position. If a specific second register value is written into the register R2 as a function of operating parameters of the internal combustion engine and if the value of the angle value transmitter reaches this second register value, the comparator K emits the event signal ES. Consequently, the respective second register value corresponds to a quite specific crankshaft angle at which, depending on the application of an injection module, the injection process begins.

Figure 3:
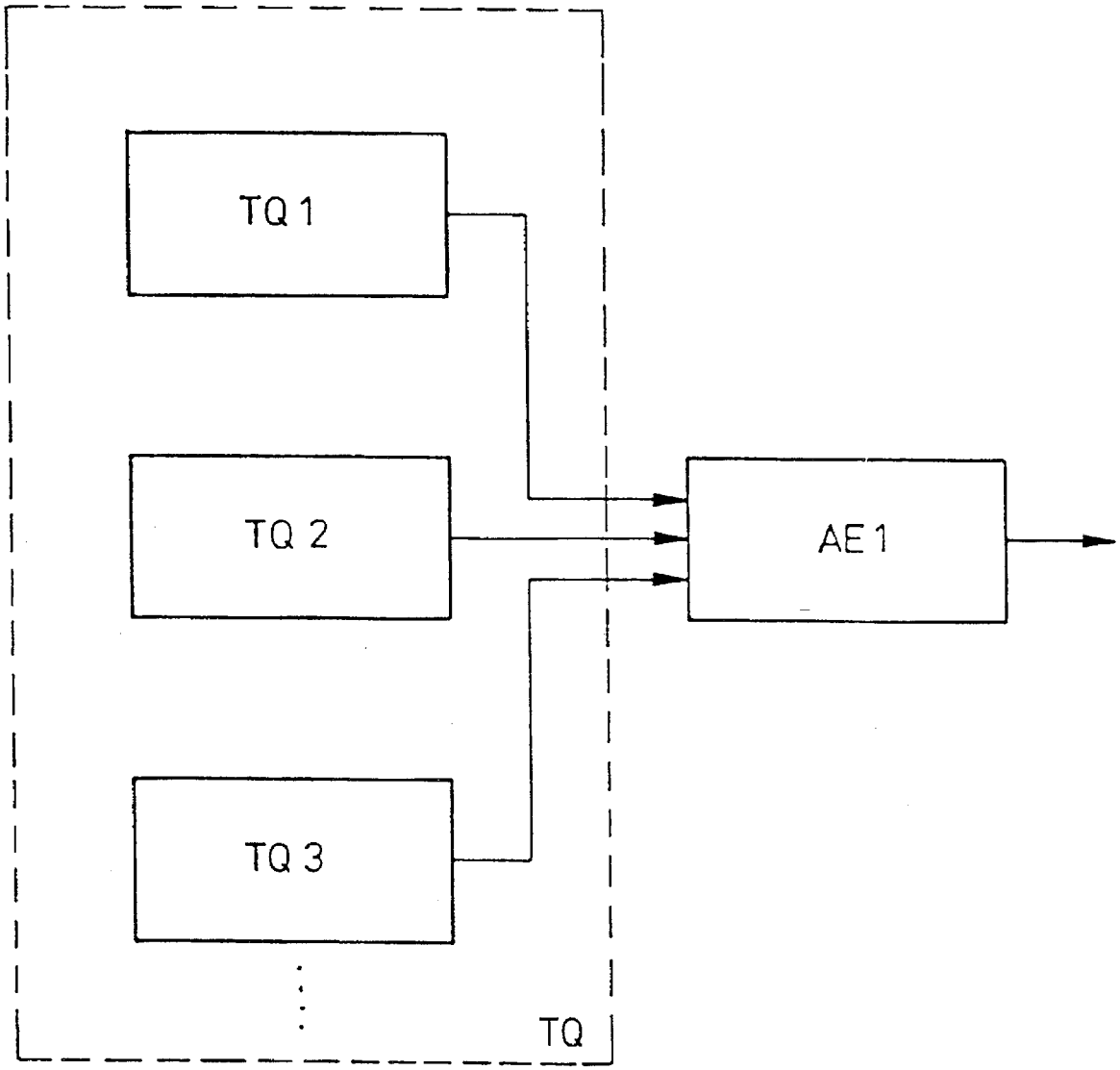
FIG. 3 shows a block circuit diagram of a clock source.

FIG. 3 shows a block circuit diagram of the clock source TQ. It is composed of a plurality of individual clock sources TQ1, TQ2, TQ3 etc. The clock data of the individual clock sources TQ1, TQ2, TQ3 are fed to a first selection device AE1. As a function of parameters of the process to be controlled, the first selection device AE1 selects one of the individual clock sources TQ1, TQ2, TQ3 whose clock is fed to the counter Z. Because of the plurality of individual clock sources TQ1, TQ2, TQ3, the counting frequency of the counter Z can thus be influenced as desired.

Figure 4:
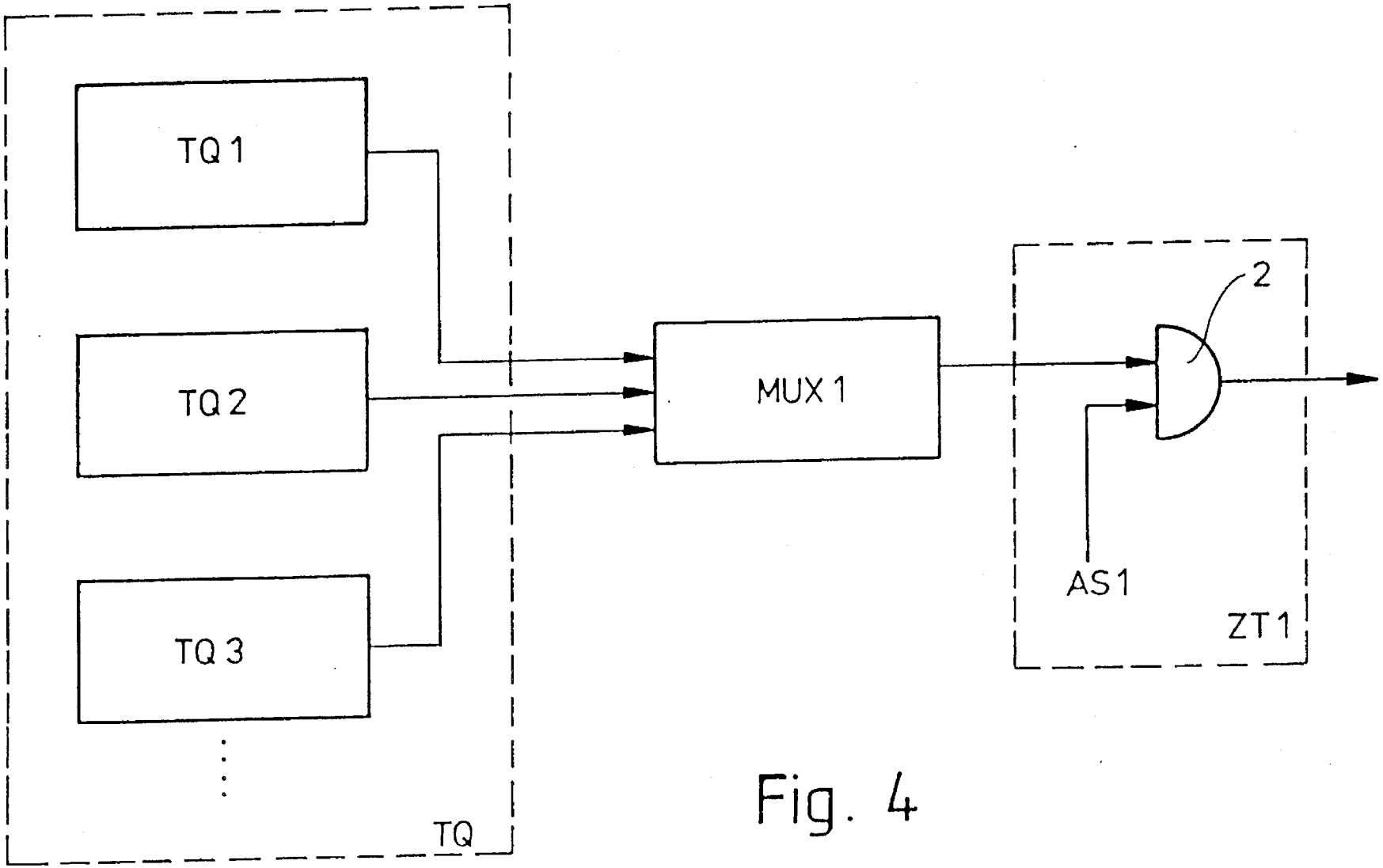
FIG. 4 shows a further exemplary embodiment of a clock source.

FIG. 4 shows a further exemplary embodiment of a clock source TQ. Again, a plurality of individual clock sources TQ1, TQ2, TQ3 etc. which feed their clock data to a first multiplexer MUX1 are provided. The multiplexed clock output of the first multiplexer MUX1 is connected to a timing selection device ZT1. Thus, all the clock data of the individual clock sources TQ1, TQ2, TQ3 are available at the multiplexed clock output of the first multiplexer MUX1, the timing selection device ZT1 selecting the clock data of that individual clock source TQ1, TQ2, TQ3 which are to be fed to the counter. Thus, it is also possible to select the clock frequency in this exemplary embodiment.

The timing selection device ZT1 in FIG. 4 has a first AND element 2. One input of this first AND element 2 is connected to the multiplexed clock output of the first multiplexer MUX1. A first selection signal AS1 can be fed to a second input of the first AND element. As a result, it is possible to select the timing of the desired clock. Whenever the desired clock is present at one input of the AND element, the said clock is transmitted to the output of the first AND element 2 by applying the first selection signal AS1, and the said clock can thus be fed to the counter Z.

Figure 5:
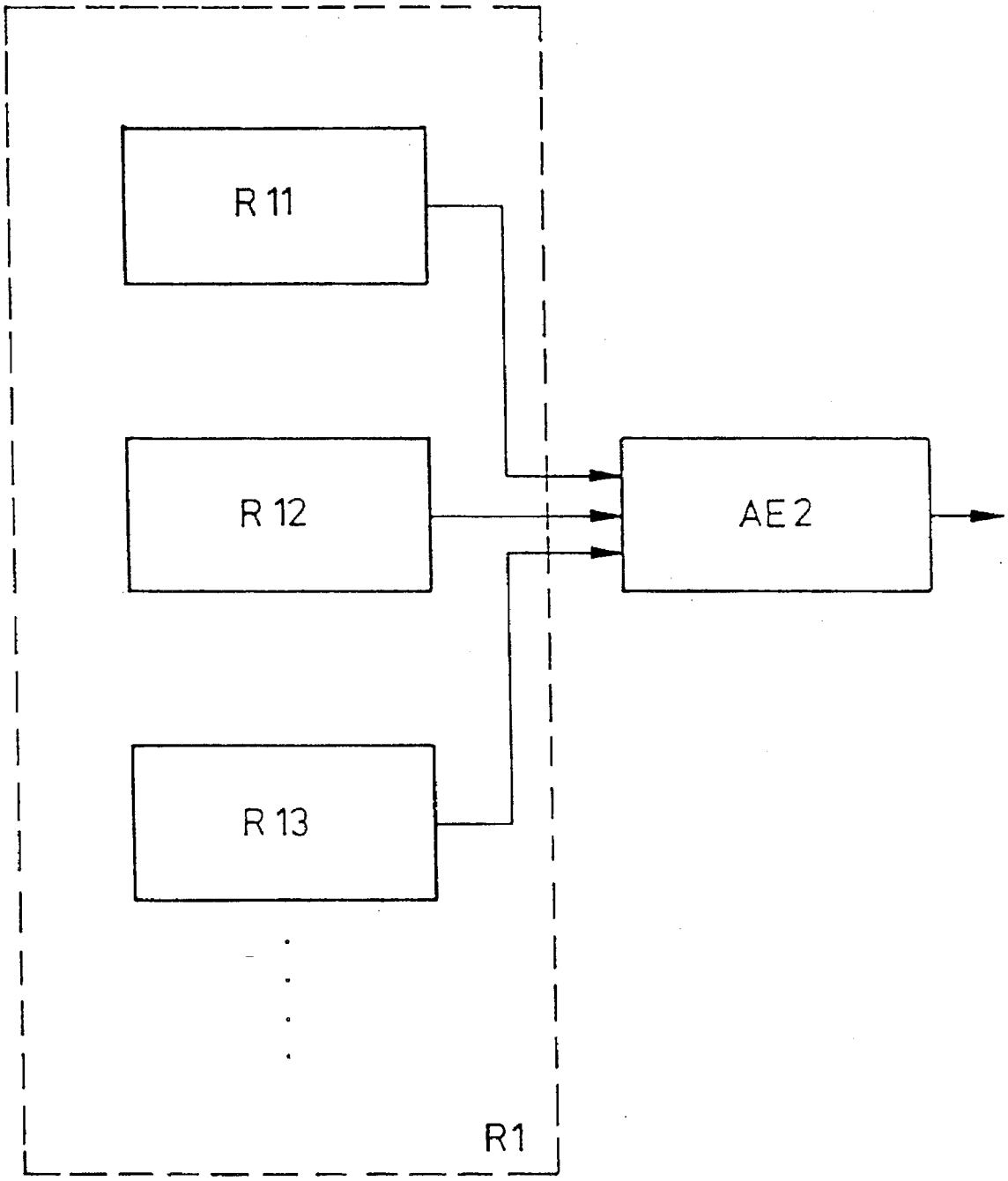
FIG. 5 shows a block circuit diagram of a first register.

According to FIG. 5, the first register R1 can have a plurality of first individual registers R11, R12, R13 etc.

The outputs of all the first individual registers R11, R12, R13 are connected to a second selection device AE2. The latter is influenced by corresponding parameters of the process to be controlled and thus permits one of the first individual registers R11, R12, R13 to be selected so that its value is fed from the loading device to the counter Z as soon as an event signal is present.

Figure 6:
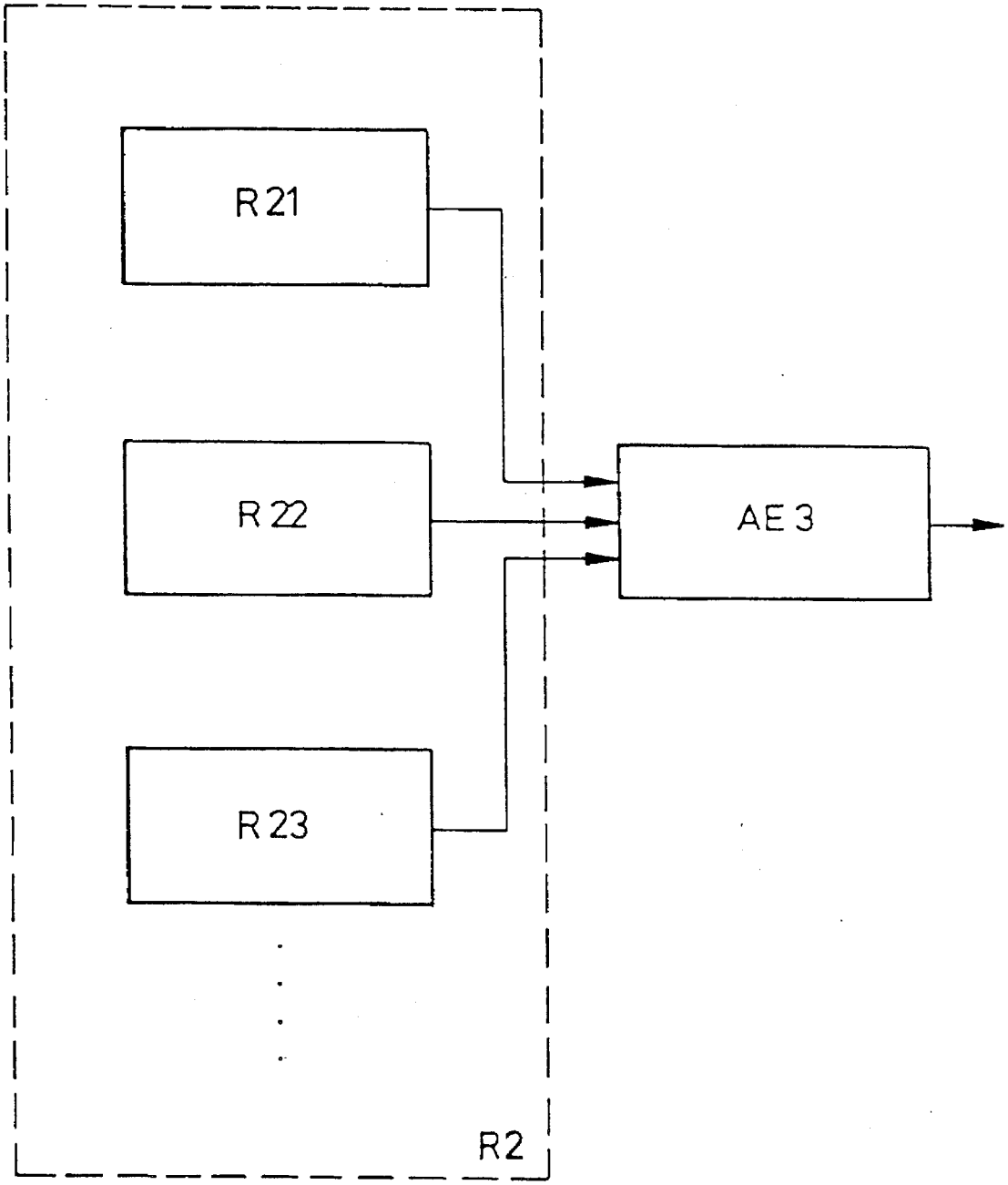
FIG. 6 shows a block circuit diagram of a second register.

FIG. 6 shows that the second register R2 can also have a plurality of second individual registers R21, R22, R23 etc. which are connected to a third selection device AE3. The third selection device AE3 permits one of the second individual registers R21, R22, R23 to be selected so that the corresponding second register value of the selected second individual register can be fed to the comparator K.

Figure 7:
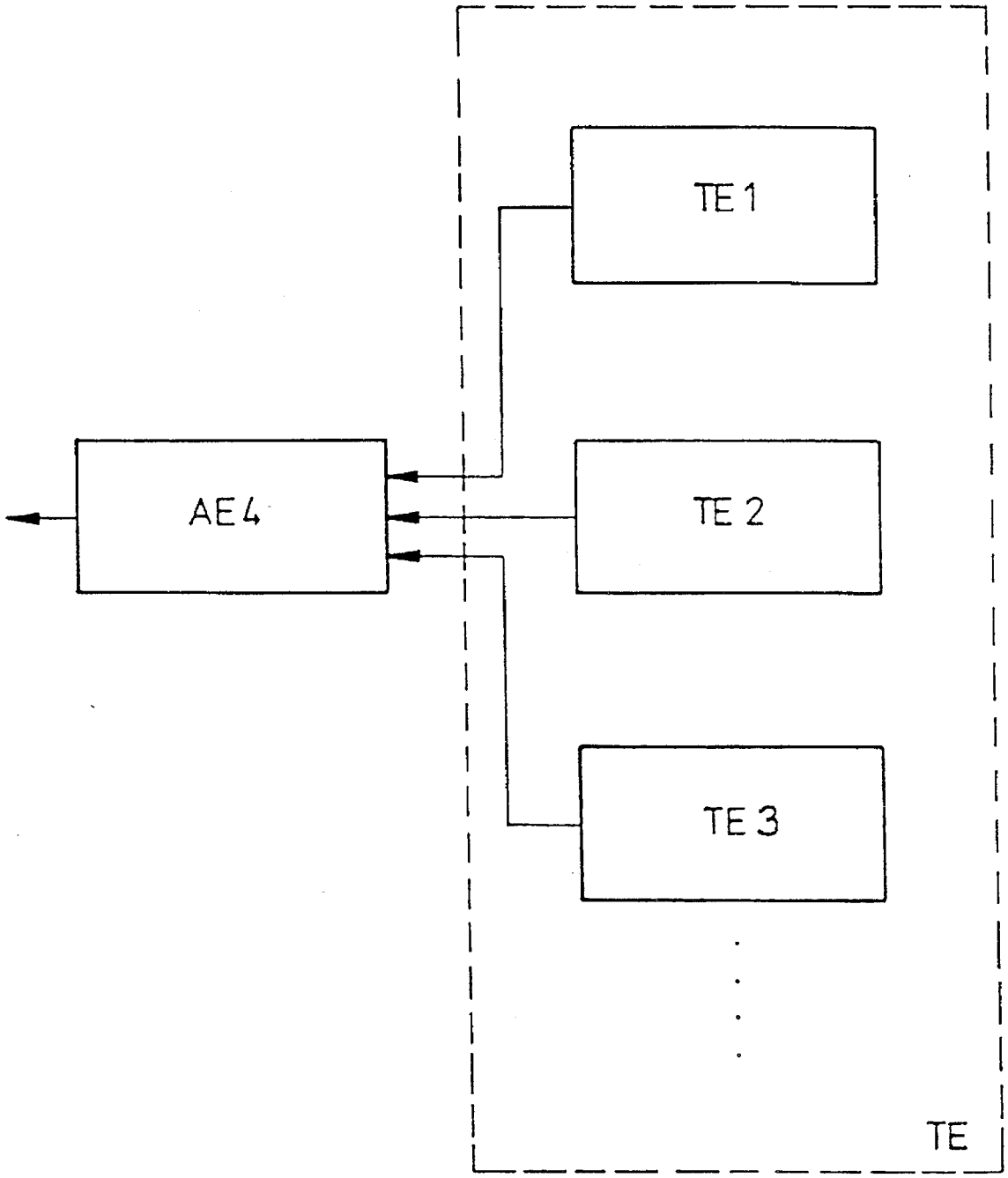
FIG. 7 shows a block circuit diagram of a clock device.

The design of the clock device TE is explained in greater detail in FIG. 7. It has a plurality of individual clock devices TE1, TE2, TE3 etc. which are connected to a fourth selection device AE4. By means of this fourth selection device AE4 a selection can be made between the individual clock devices TE1, TE2, TE3, that is, the clock of the selected individual clock device is fed to the comparator K. Individual settings can thus be made by virtue of the plurality of individual clock devices TE1, TE2, TE3.

Figure 8:
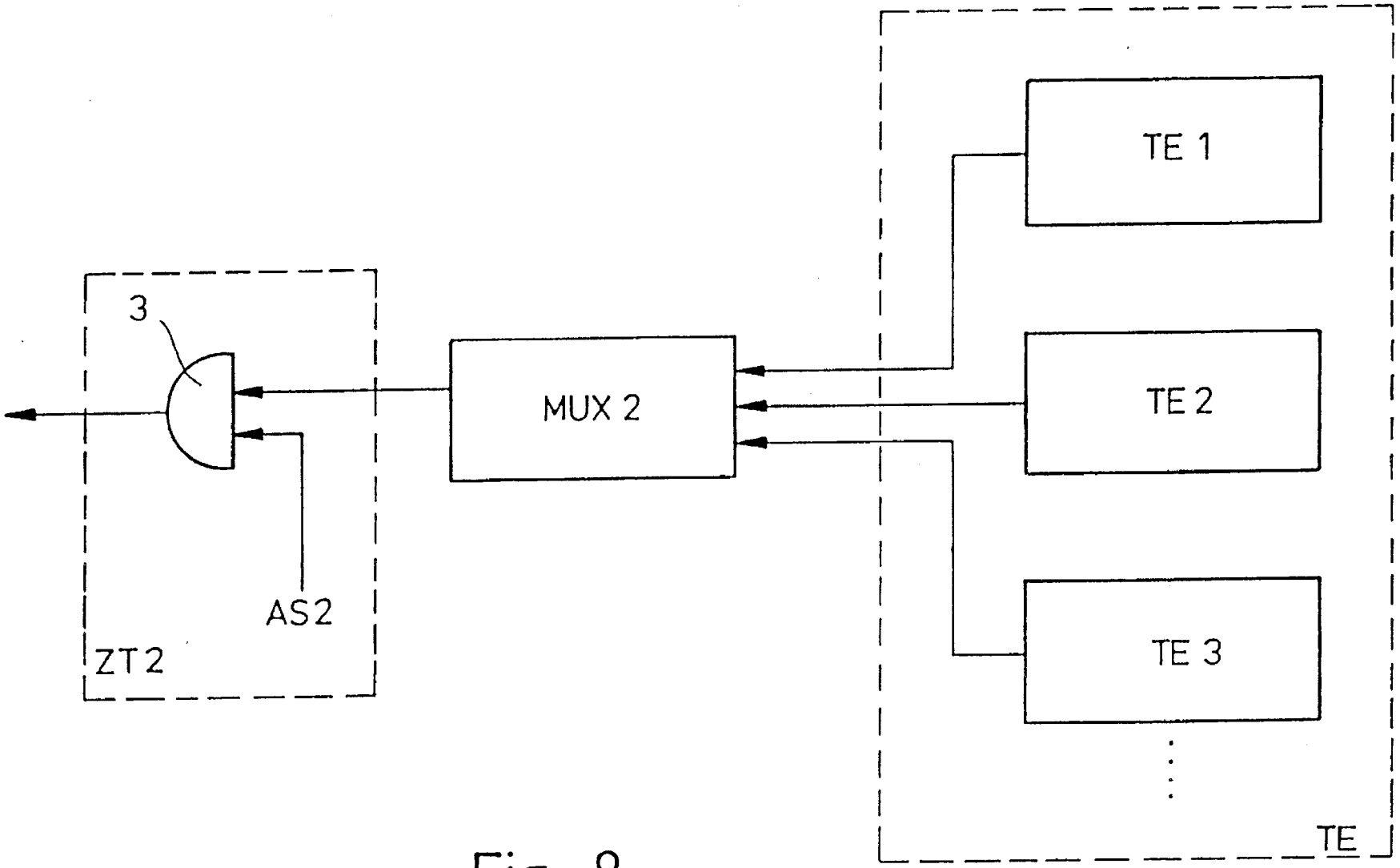
FIG. 8 shows a block circuit diagram of a further exemplary embodiment of a clock device.

FIG. 8 shows a further exemplary embodiment of a clock device TE by means of a block circuit diagram. The clock device TE again has a plurality of individual clock devices TE1, TE2, TE3 etc. which are connected to a second multiplexer MUX2. The multiplexed clock output of the second multiplexer MUX2 is connected to a second thing selection device ZT2. The latter selects the desired clock data of the selected individual clock device from the plurality of clock data of the individual clock devices TE1, TE2, TE3 at the multiplexed clock output of the second multiplexer MUX2. Preferably, the second thing selection device ZT2 has a second AND element 3 to one input of which the multiplexed clock output of the second multiplexer MUX2 is connected. A second selection signal AS2 for selecting the timing of the correspondingly desired clock is fed to a further input of the second AND element 3. When there is coincidence, the corresponding clock is connected to the output of the AND element and to the comparator K.

Figure 9:
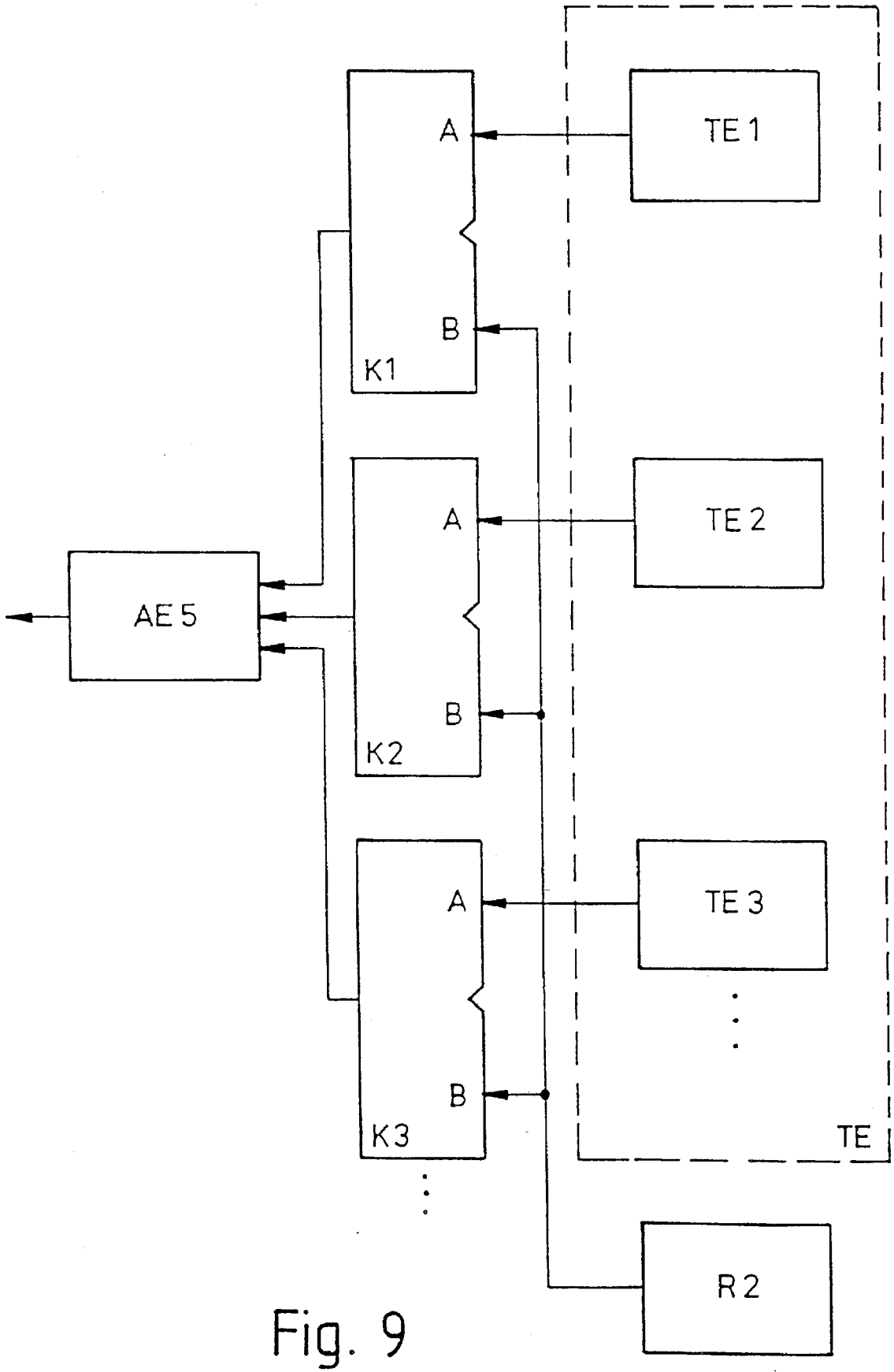
FIG. 9 shows a block circuit diagram of a further exemplary embodiment of a clock device.

According to FIG. 9, it is also possible according to a further exemplary embodiment for the clock device TE to have a plurality of individual clock devices TE1, TE2, TE3 etc. which are each connected to the A input of a comparator K1, K2, K3 etc. The second input B of the individual comparators K1, K2, K3 is connected to the output of the second register. The outputs of the comparators K1, K2, K3 are fed to a fifth selection device AE5. Whenever there is coincidence between the individual clock data of the individual clock devices TE1, TE2, TE3 and the corresponding second register value of the second register R2, the comparators K1, K2, K3 connect and transmit their output signal to the fifth selection device AES. The latter selects a corresponding output signal from the plurality of output signals of the comparators K1, K2, K3 according to prescribable operating parameters and outputs the output signal as an event signal ES to the loading device L.

Figure 10:
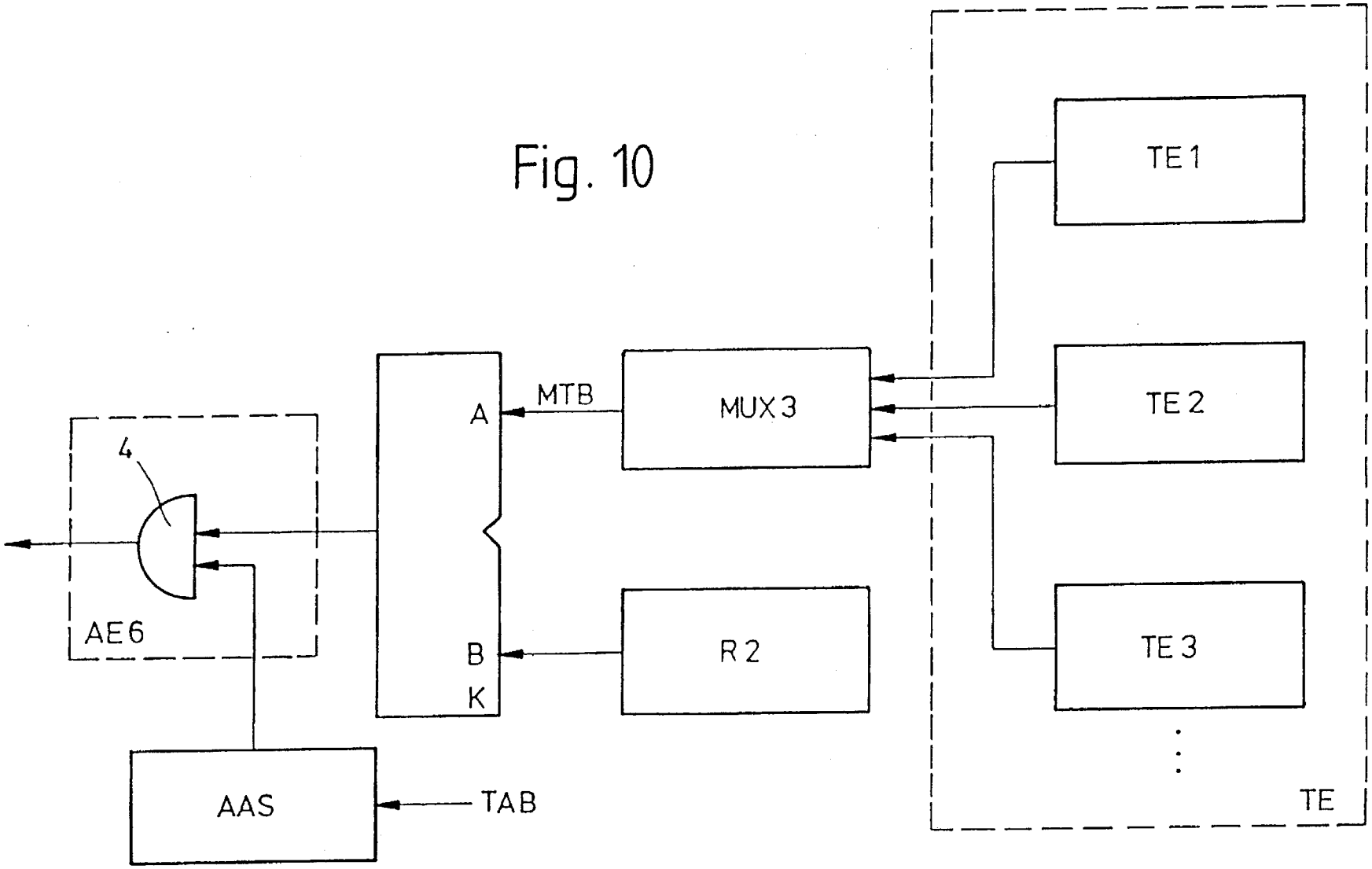
FIG. 10 shows a last exemplary embodiment of a clock device and FIG. 11 shows a diagram illustrating an application of the control device.

A further variant is illustrated in FIG. 10. Again, the clock device TE has a plurality of individual clock devices TE1, TE2, TE3 etc. which are connected to a third multiplexer MUX3. The multiplexed clock output of the third multiplexer MUX3 is connected to the A input of the comparator K via a multiplex clock-data bus MTB. The B input of the comparator K is connected to the output of the second register R2. The output of the comparator K is connected to a sixth selection device AE6 whose output emits the event signal ES. The sixth selection device AE6 has a third AND element 4, to an input of which the output of the comparator K is connected. A further input of the third AND element 4 is connected to an address selection circuit AAS. The latter is fed all the addresses of the clock data of the individual clock devices TE1, TE2, TE3 by means of a clock-address bus TAB. Whenever there is coincidence between the clock data on the multiplex clock-data bus MTB and the second register value of the second register R2, the comparator K connects through and transmits an output signal to the third AND element 4. By means of the address selection circuit AAS to which all the addresses of the clock data are fed via the clock-address bus TAB, the clock data of the desired individual clock device TE1, TE2, TE3 can be selected by selecting specific addresses and the clock data are then available at the output of the third AND element 4 as an event signal ES.

Figure 11:
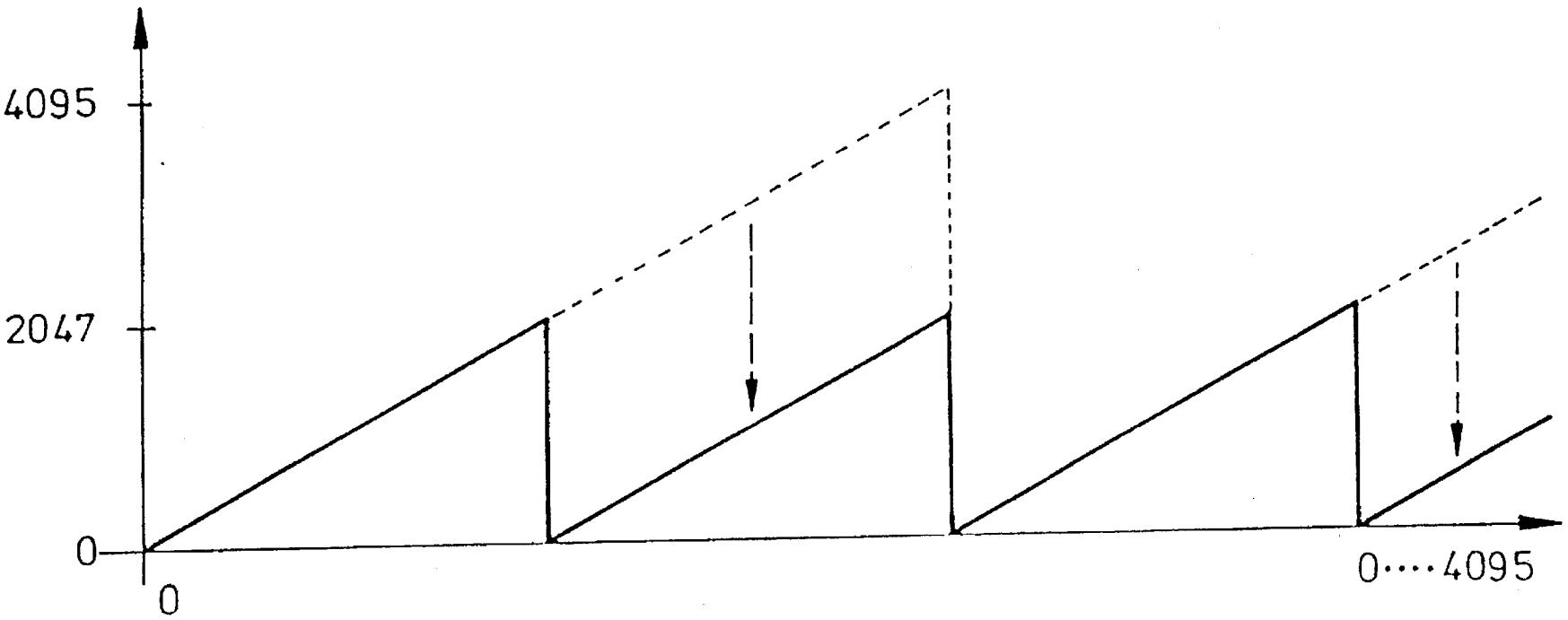

FIG. 11 shows, for the practical application of an injection module, that an instantaneous data value can be projected onto part of a cycle by inserting or extracting bits of the clock data of the clock device TE. If the number of a 12-bit clock device corresponds for example to an angle between 0° and 720° (that is to say two revolutions) of the crankshaft, the values of the second revolution can always be projected onto the first revolution by extracting a bit (there are then only 11 bits available). The 720° of a crankshaft engine cycle which are necessary in motor vehicle control can thus also be interpreted as a 360° crankshaft position with the same angle source. In FIG. 11, the number 4095 corresponds to the 12-bit value and the number 2047 corresponds to the 11-bit value.

The device according to the invention thus provides a structure for mixed digital processing of various electronic databases, for example time base and/or angle base, which can be used for example in motor vehicle injection technology. Of course, it is also possible to use the invention as an ignition module. Depending on the initial state, the module compares one value of the second register R2 with the crankshaft angle (clock device TE). When there is identity, an output signal is set or cleared and thus ignition is triggered as soon as a trailing edge of the output signal (ignition angle) is present. The following variant is possible: the ignition is, as described above, switched on when there is identity with a corresponding starting angle but is switched off after an opening angle present in the first register R1 has passed. Here, the first register value present in the first register is decremented with the clock of the clock source.

It is a basic fact that the conversion of the angle base to a time-oriented base in the motor vehicle application constitutes a special feature. A high degree of universality of the structure used for an extremely wide variety of functions can be utilized even with two different time/angle bases, such as are formed by the clock source TQ and the clock device TE. The aforesaid structure is conceived for incremental bases which cover all possible intermediate values between two values. The clock output of these bases is used as a relative value. In particular, cyclic bases are supported, for example a (crankshaft) angle base which, depending on the angle from 0° to 720°, counts respectively from 0 to 719 in order to start at 0 again. If pure incremental bases are not only used as a relative value, regular accessing of the processor to change the second register value is required. In the case of the aforesaid injection module, the module compares a value in the second register with the crankshaft angle (clock device TE). When there is identity, the contents of the first register are loaded into the counter and counted down (clock source) with clock poles of for example one microsecond. If the next identity of the value of the second register with the clock device is detected before the counter has reached its final counter state, for example zero value, the counter is loaded again with the value of the first register (continual transition from injection to continuous wave and back). The state of the counter (counting state or the fact that the final counting state has been reached) corresponds to the output signal for the injection valve (start of opening as angle base, opening time as time base). A complete loading process can be performed from the start of opening and opening time, while the last cycle is actually being executed, since the data can be overwritten as often as desired until they are used. An injection that has already been triggered can be prolonged or shortened at any time by directly changing the counter state, for example by writing a value into a counter state which has already counted to zero, as a result of which after-dribbling is achieved.

We claim:

1. An electronic control device for controlling a fuel injection starting time and an injection duration in an internal combustion engine, said electronic control device comprising an event device (E) including means for generating an event signal (ES) as a function of a prescribed occurrence of an event, said event device (E) including a second register (R2), a clock device (TE) and comparator (K), said comparator including means for comparing a stored register value in the second register (R2) with a value from the clock device (TE) and producing a comparator signal for generation of the event signal (ES) when the stored register value corresponds to the value from the clock device;

means for controlling the injection duration comprising a first register (R1), a loading device (L) and a counter (Z), a variable register value for the injection duration being stored in the first register (R1), said loading device (L) being connected to said event device (E) to receive said event signal (ES) at a loading device input;

means for inputting said variable register value in the first register (R1) into the counter (Z) as a starting value of said counter when the event signal (ES) is input into the loading device (L);

means for starting the counter (Z) and an injection process when the variable register value is input into the counter (Z); and means for stopping said counter (Z) and an injection process when a count in the counter reaches a predetermined count value.

2. The electronic control device as defined in claim 1, further comprising a counter-state evaluation means (ZA) for determining a state of said counter (Z), said counter-state evaluation means (ZA) including a part of said means for starting the counter and the ignition process and a part of said means for stopping the counter and the ignition process.

3. The electronic control device as defined in claim 1, wherein the counter (Z) includes means for incrementing the count in the counter.

4. The electronic control device as defined in claim 1, wherein the counter (Z) includes means for decrementing the count in the counter.

5. The electronic control device as defined in claim 1, wherein the predetermined count value is zero so that the counter and the ignition process stop when the count in the counter reaches zero.

6. The electronic control device as defined in claim 1, further comprising a clock source (TQ) connected to the counter (Z) and having a constant time base.

7. The electronic control device as defined in claim 1, further comprising a clock source (TQ) connected to the counter (Z) and wherein the clock source is an asynchronous source.

8. The electronic control device as defined in claim 1, further comprising a clock source (TQ) including a plurality of individual clock sources (TQ1, TQ2, TQ3) and a first means (AE1) for selecting one of the individual clock sources (TQ1, TQ2, TQ3) for connection with the counter (Z).

9. The electronic control device as defined in claim 1, further comprising a clock source (TQ) including a plurality of individual clock sources (TQ1, TQ2, TQ3), a first multiplexer (MUX1) connected with each of the individual clock sources (TQ1, TQ2, TQ3) to provide an output signal from each of the individual clock sources at a multiplexed clock output of the first multiplexer (MUX1) and a first timing selection means (ZT1) connected with the first multiplexer (MUX1) to select the output signal at the multiplexed clock output to be fed to the counter (Z).

10. The electronic control device as defined in claim 9, wherein the first timing selection means (ZT1) includes a first AND element having two inputs and an output, wherein one of the two inputs of the first AND element is connected to the multiplexed clock output of the first multiplexer (MUX1) and another of the two inputs is connected to a means for feeding a first selection signal (ASI) for selecting clock timing, and the output of the first AND element is connected to the counter (Z) for connection of the counter (Z) to the selected one of the individual clock sources (TQ1, TQ2, TQ3).

11. The electronic control device as defined in claim 1, wherein the first register (R1) includes a plurality of first individual registers (R11, R12, R13) and a second selection means for selecting one of the first individual registers (R11, R12, R13) to provide the first register value.

12. The electronic control device as defined in claim 1, wherein the second register (R2) includes a plurality of second individual registers (R21, R22, R23), and a third selection means (AE3) for selecting one of the second individual registers (R21, R22, R23) to provide the second register value to the comparator (K).

13. The electronic control device as defined in claim 1, wherein the clock device (TE) of the event device (E) includes a plurality of individual clock devices (TE1, TE2, TE3), and the event device (E) includes a fourth selection means (AE4) for selecting one of the individual clock devices (TE1, TE2, TE3) for connection to the comparator (K).

14. The electronic control device as defined in claim 1, wherein the clock device (TE) of the event device (E) includes a plurality of individual clock devices (TE1, TE2, TE3) and the event device (E) includes a second multiplexer (MUX2) connected to the individual clock devices (TE1, TE2, TE3) and having a multiplexed clock output, and a second timing selection means (ZT2) for selecting an output signal of one of the individual clock devices (TE1, TE2, TE3) at the multiplexed clock output of the second multiplexer (MUX2) to be fed to the comparator (K).

15. The electronic control device as defined in claim 14, wherein the second timing selection device (ZT2) includes a second AND element having an output and two inputs, wherein one of the two inputs of the second AND element is connected to the multiplexed clock output of the second multiplexer (MUX2) and a second selection signal (AS2) for selecting clock timing is fed to another of the two inputs of the second AND element, and the output of the second AND element is connected to the comparator (K).

16. The electronic control device as defined in claim 1, wherein the clock device (TE) of the event device (E) includes a plurality of individual clock devices (TE1,TE2, TE3), and the event device (E) includes a plurality of individual comparators (K), each of said individual comparators (K) having an output and two inputs, and a fifth selection means (AE5) for selecting one of the individual comparators (K); and wherein one of the two inputs of each individual comparator (K) is connected to a respective one of the individual clock devices (TE1, TE2, TE3) and another one of the two inputs of each individual comparator (K) is connected to the second register (R2) to receive the second register value, and the outputs of the individual comparators (K) are connected to the fifth selection device (AE3) for selection of an output signal from a selected one of the individual comparators (K).

17. The electronic control device as defined in claim 1, wherein the clock device (TE) of the event device (E) includes a plurality of individual clock devices (TE1, TE2, TE3) and the event device (E) includes a third multiplexer (MUX3) having a multiplexed clock output and connected to receive input signals from each of the individual clock devices (TE1, TE2, TE3), the comparator (K) has two inputs and an output, one of the two inputs of the comparator (K) being connected to the multiplexed clock output of the third multiplexer (MUX3), an address selection circuit (AAS) to which addresses of clock data of the individual clock devices (TE1, TE2, TE3) are fed and a sixth selection means (AE6) for outputting the event signal (ES), said sixth selection means (AE6) being connected to the output of the comparator (K) and to the address selection circuit (AAS).

18. The electronic control device as defined in claim 17, wherein the multiplexed clock output of the third multiplexer (MUX3) is connected to the comparator (K) by a multiplex clock-data bus (MTB).

19. The electronic control device as defined in claim 18, further comprising means for feeding addresses of clock data of the individual clock devices (TE1, TE2, TE3) to the address selection circuit (AAS), said means for feeding addresses comprising a clock-address bus (TAB).

20. The electronic control device as defined in claim 17, wherein the sixth selection means (AE6) has a third AND element having two inputs and an output at which the event signal (ES) is emitted, one of the two inputs of the third AND element is connected to the output of the comparator (K) and another of the two inputs of the third AND element is connected to an address selection circuit (AAS).

21. The electronic control device as defined in claim 18, wherein the event device (E) includes means for transmitting data of the individual clock devices (TE1, TE2, TE3) onto the common multiplex clock-data bus (MTB) only if data of one of the individual clock devices (TE1, TE2, TE3) have changed or if a request is made.

22. The electronic control device as defined in claim 19, wherein the event device includes means for transmitting data of the clock-address bus (TAB) by the multiplex clock-data bus (MTB) prior to transmission of data of the associated individual clock device (TE1, TE2, TE3).

23. The electronic control device as defined in claim 18, wherein the event device (E) includes means for transmitting said addresses of the clock data on the multiplex clock-data bus (MTB), the addresses being transmitted prior to transmission of the clock data and a memory for the addresses.

24. The electronic control device as defined in claim 1, wherein the clock device (TE) includes means for programmable extraction or insertion of data bits of clock data of the clock device.

25. The electronic control device as defined in claim 1, further comprising a clock source (TQ) connected to the counter (Z) and wherein the clock source (TQ) includes means for programmable extraction or insertion of data bits of clock data of the clock device.

26. The electronic control device as defined in claim 1, wherein the clock device (TE) is an angle value transmitter.

27. The electronic control device as defined in claim 26, wherein the angle value transmitter generates a signal according to an angular position of a crankshaft of the internal combustion engine.

28. The electronic control device as defined in claim 1, further comprising a clock source (TQ) connected to the counter (Z) and is an angle value transmitter.

29. An electronic control device for controlling a fuel injection starting time and an injection duration in an internal combustion engine having a crankshaft, said electronic control device comprising an event device (E) including means for generating an event signal (ES) according to a crank angle of the crankshaft of the internal combustion engine, said event device (E) comprising a crankshaft angle transmitter (TE) generating an angular position signal indicative of an angular position of the crankshaft, a second register (R2), and comparator (K), said comparator including means for comparing a stored register value in the second register (R2) with a value from the crankshaft angle transmitter and producing a comparator signal for generation of the event signal (ES) when the stored register value corresponds to the value from the clock device;

means for controlling the injection duration comprising a first register (R1), a loading device (L) and a counter (Z), a variable register value for the injection duration being stored in the first register (R1), said loading device (L) being connected to said event device (E) to receive said event signal (ES) at a loading device input;

means for inputting said variable register value in the first register (R1) into the counter (Z) as a starting value of said counter when the event signal (ES) is input into the loading device (L);

means for starting the counter (Z) and an injection process when the variable register value is input into the counter (Z); and means for stopping said counter (Z) and an injection process when the counter reaches a predetermined count.

30. The electronic control device as defined in claim 29, further comprising a clock source (TQ) connected to the counter (Z) and having a constant time base.

31. The electronic control device as defined in claim 29, further comprising a clock source (TQ) connected to the counter (Z) and the clock source is an asynchronous source.

32. The electronic control device as defined in claim 29, further comprising a clock source (TQ) and including a plurality of individual clock sources (TQ1, TQ2, TQ3) and a first means (AE1) for selecting one of the individual clock sources (TQ1, TQ2, TQ3) for connection with the counter (Z).

33. The electronic control device as defined in claim 29, further comprising a clock source (TQ) and including a plurality of individual clock sources (TQ1, TQ2, TQ3), a first multiplexer (MUX1) connected with each of the individual clock sources (TQ1, TQ2, TQ3) to provide an output signal from each of the individual clock sources at a multiplexed clock output of the first multiplexer (MUX1) and a first timing selection means (ZT1) connected with the first multiplexer (MUX1) to select the signal at the multiplexed clock output to be fed to the counter (Z).

* * * * *